US007624844B2

(12) United States Patent
Alexander

(10) Patent No.: US 7,624,844 B2
(45) Date of Patent: Dec. 1, 2009

(54) LADDER SUPPORT AND LIFT SYSTEM

(76) Inventor: Larry Alexander, 8750 Pendleton Pike, Indianapolis, IN (US) 46226

( * ) Notice: Subject to any disclaimer, the term of this patent is extended or adjusted under 35 U.S.C. 154(b) by 531 days.

(21) Appl. No.: 11/398,932

(22) Filed: Apr. 7, 2006

(65) Prior Publication Data

US 2007/0235257 A1 Oct. 11, 2007

(51) Int. Cl.
*E06C 5/00* (2006.01)

(52) U.S. Cl. ..... 182/127

(58) Field of Classification Search ..... 182/127
See application file for complete search history.

(56) References Cited

U.S. PATENT DOCUMENTS 1,812,119 A * 6/1931 Ruse ..... 182/180.3
4,580,660 A * 4/1986 Oling ..... 182/107
4,909,352 A * 3/1990 McComb ..... 182/127
5,137,320 A * 8/1992 Christensen ..... 296/3
6,053,284 A * 4/2000 Fountain ..... 182/180.2
6,260,910 B1 * 7/2001 Kay ..... 296/167
7,097,409 B2 * 8/2006 Richter ..... 414/462
2004/0140155 A1 * 7/2004 Yang et al. ..... 182/107
2005/0247517 A1 * 11/2005 Vetesnik ..... 182/12
2006/0169536 A1 * 8/2006 Davis ..... 182/127

* cited by examiner

*Primary Examiner*—Alvin C Chin-Shue
(74) *Attorney, Agent, or Firm*—Daniel J. O'Connor

(57) ABSTRACT

A ladder lift system and method of use includes a specially designed clamp element which is connected between an extension ladder and a pivotable lift rail. The system includes a lower ladder support. The system is especially adapted for use in combination with the bed of a transport or pick-up truck. The system and method of use allows a single workman to safely and easily utilize an extension ladder for a wide variety of work and service tasks. The invention kit may include a pair of clamp elements with a lower ladder support.

1 Claim, 8 Drawing Sheets

LADDER SUPPORT AND LIFT SYSTEM

BACKGROUND AND OBJECTS OF THE INVENTION

The present invention is generally related to the support and lift arts of Class 248 and, in particular, to a ladder lift system and method of use.

For many service and repair usages, an extension ladder is transported on a truck to the work site. Longer extension ladders often require more than one workman for unloading and safe utilization of the extension ladder. The manner of attachment of an extension ladder to a truck also becomes a safety issue, i.e. one must ensure that an extension ladder does not fall off the truck during transport to the work site.

Accordingly, it is an object of the present invention to set forth a novel ladder lift and support system which enables ease of set-up and use by a single workman.

It is a further object to demonstrate a ladder lift system which is mounted on a truck bed and which is utilized from the truck bed position so that no ladder unloading is required.

It is also an object to show a system and method of ladder usage which enhances safety for a workman without costly manufacturing processes and expenses.

It is a still further object of the present invention to demonstrate a novel clamping system which may be economically produced and which results in a ladder lift which is solidly supported and which may be easily moved to various positions at a particular work site.

These and other objects and advantages of the present invention will be apparent to those of skill in the support and ladder lift arts from the description which follows.

PRIOR ART PATENTS AND DESIGNS

During the course of preparing this specification for submission to the U.S. Patent Office, a full search of the prior art was conducted.

U.S. Pat. Nos. 6,971,563 and 4,990,049 are at least broadly related to the present invention since they teach a combined ladder and pickup truck usage.

U.S. Pat. No. 6,971,563 issued to Levi in 2005 claim recites a clamping means adapted to cooperate with two elements to act as a coupling fastener.

The Levi Patent is classified in U.S. Patent Office Classes 224 and 296.

The present invention is submitted to clearly define over the prior art systems and methods of use as they relate to ladders and truck mounted lift designs.

SUMMARY OF THE INVENTION

A pair of specially designed clamp structures are utilized and positioned between a lift rail and the side rails of an extension ladder.

A lower support and retention element for the ladder is also provided.

Each of the clamp structures has a lower design comprising shoulders which permit mounting to a lift rail. The clamp structures also include an upper section which includes a generally C-shaped device which contacts a side rail of an extension ladder.

The overall system provides for maximum flexibility in use of a ladder at a work site, increased convenience since the ladder need not be removed from a truck, and enhanced safety for a workman since the design provides for a more solid securing of an extension or other type of ladder.

BRIEF DESCRIPTION OF THE DRAWING FIGURES

FULL DESCRIPTION OF THE PREFERRED EMBODIMENTS

Figure 1:
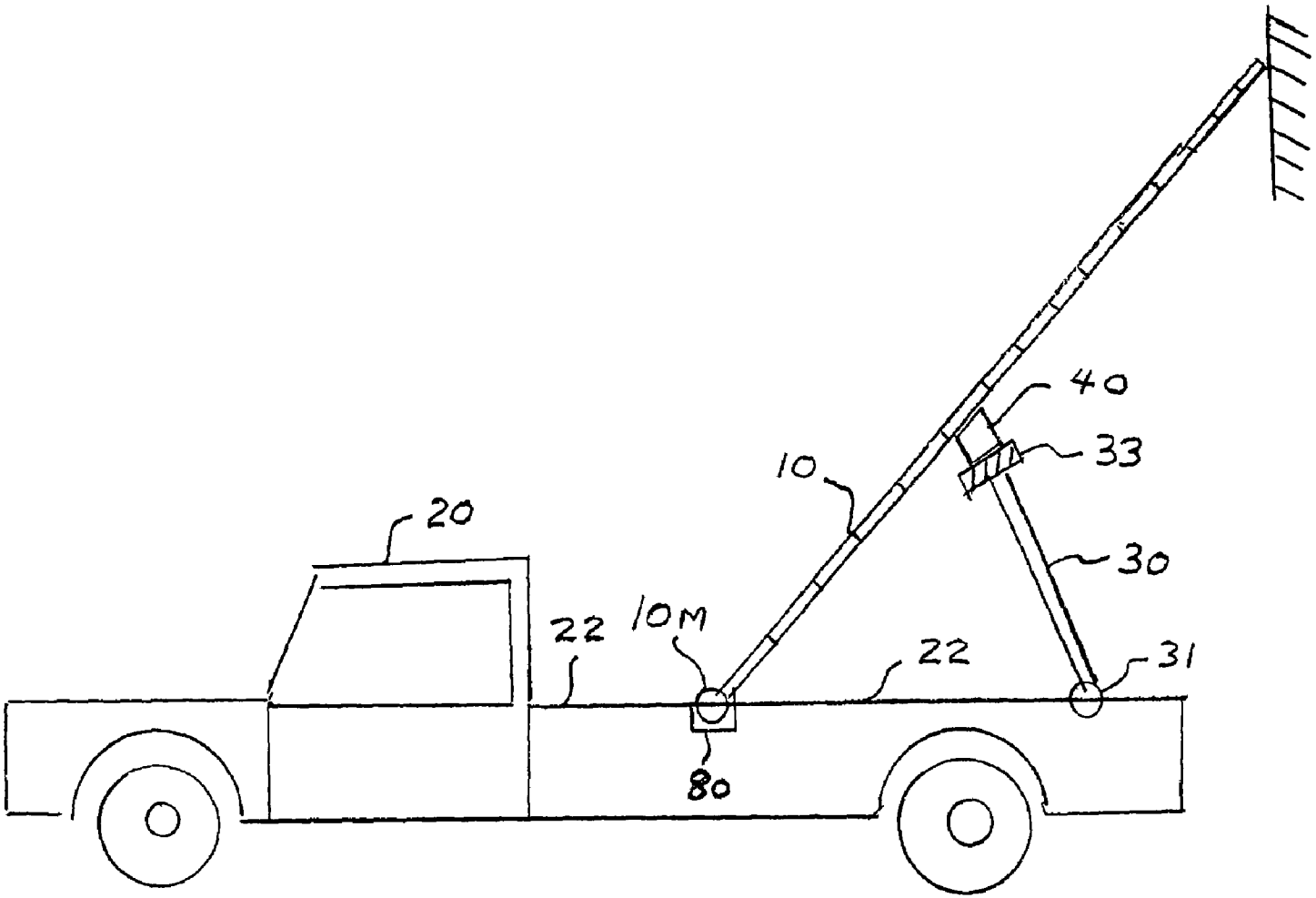
FIG. 1 is a schematic side view of the major components used in the claimed combination.

Referring to the drawing FIG. 1, the overall system is shown as being used in combination with the bed 22 of a truck 20.

A lift structure 30 is shown as being pivotable about point 31 which is mounted to the truck bed 22.

The lift 30 has an upper or top rail 33 which is very sturdy and is of a generally square or rectangular cross section.

An extension ladder is indicated at numeral 10 and as having a lower mounting point or area at numeral 10M.

As further indicated schematically in FIG. 1, clamp elements 40 are positioned to join the top rail 33 to side rails of the ladder 10.

Figure 2:
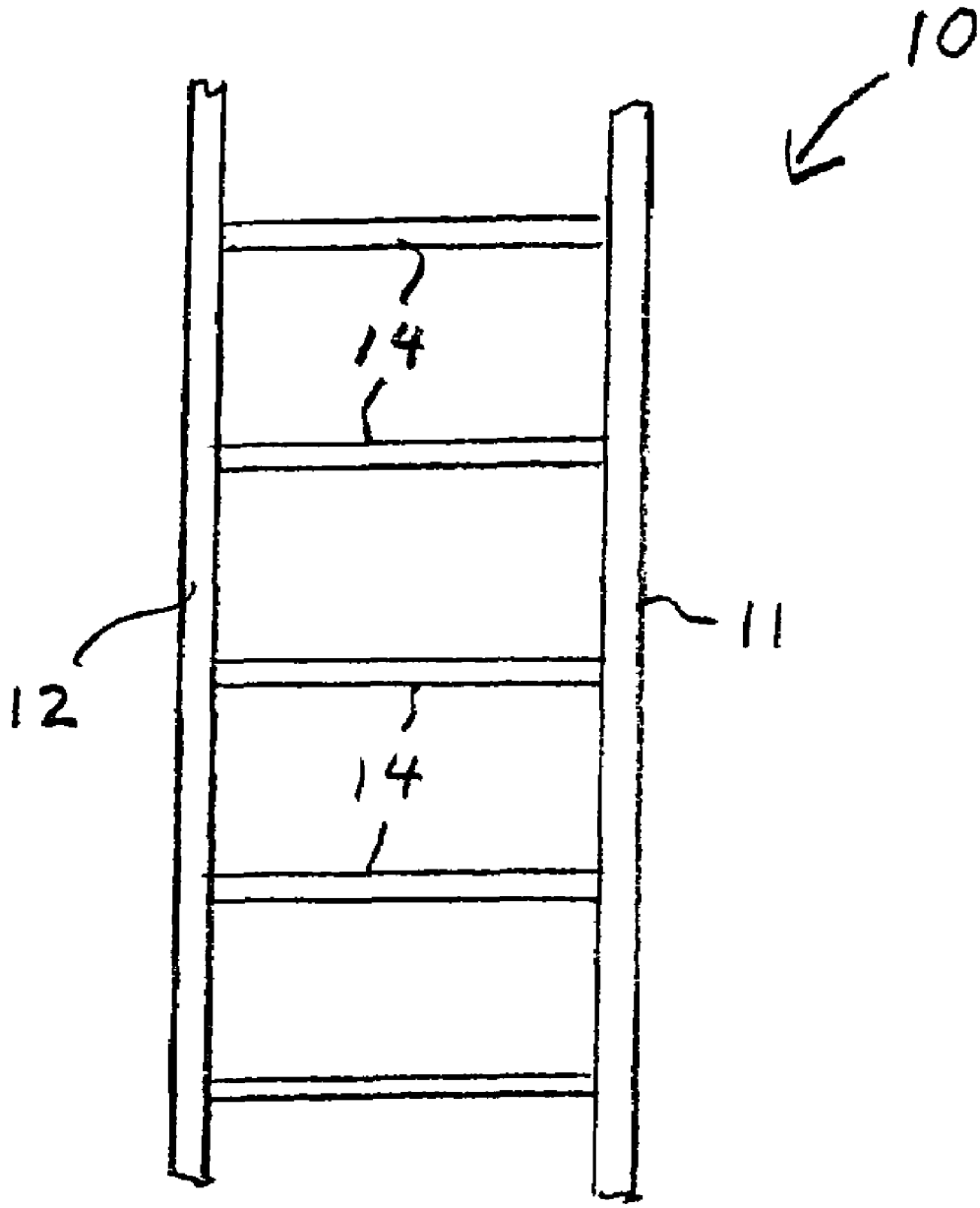
FIG. 2 is a partial view of a ladder to show components, such as side rails, which are recited in the combination.

FIG. 2 shows a portion of a conventional extension ladder 10 which has side rails indicated at 11 and 12 and rungs as shown at 14.

Figure 3:
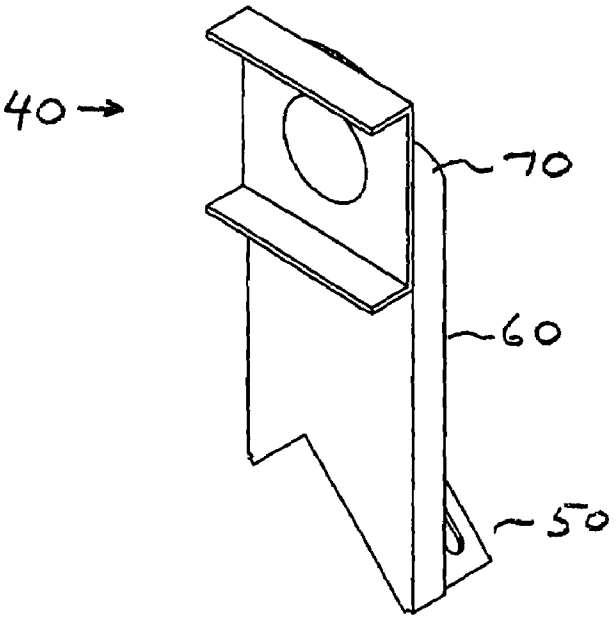
FIG. 3 is a perspective view of the clamp elements used in the invention.
Figure 3:
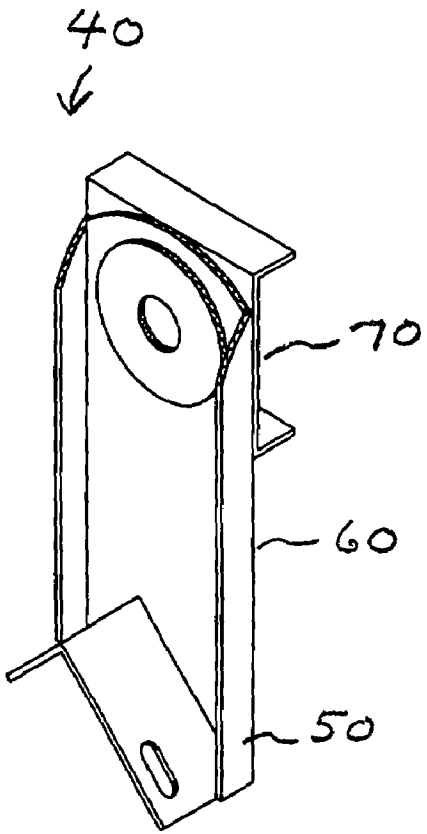

FIG. 3 shows a perspective view of the pair of clamps 40 which have been specially designed for use in the overall ladder lift and support system.

For the purposes of illustration and clear description, the clamps 40 are divided into lower section 50, middle section 60 and upper section 70.

Figure 4:
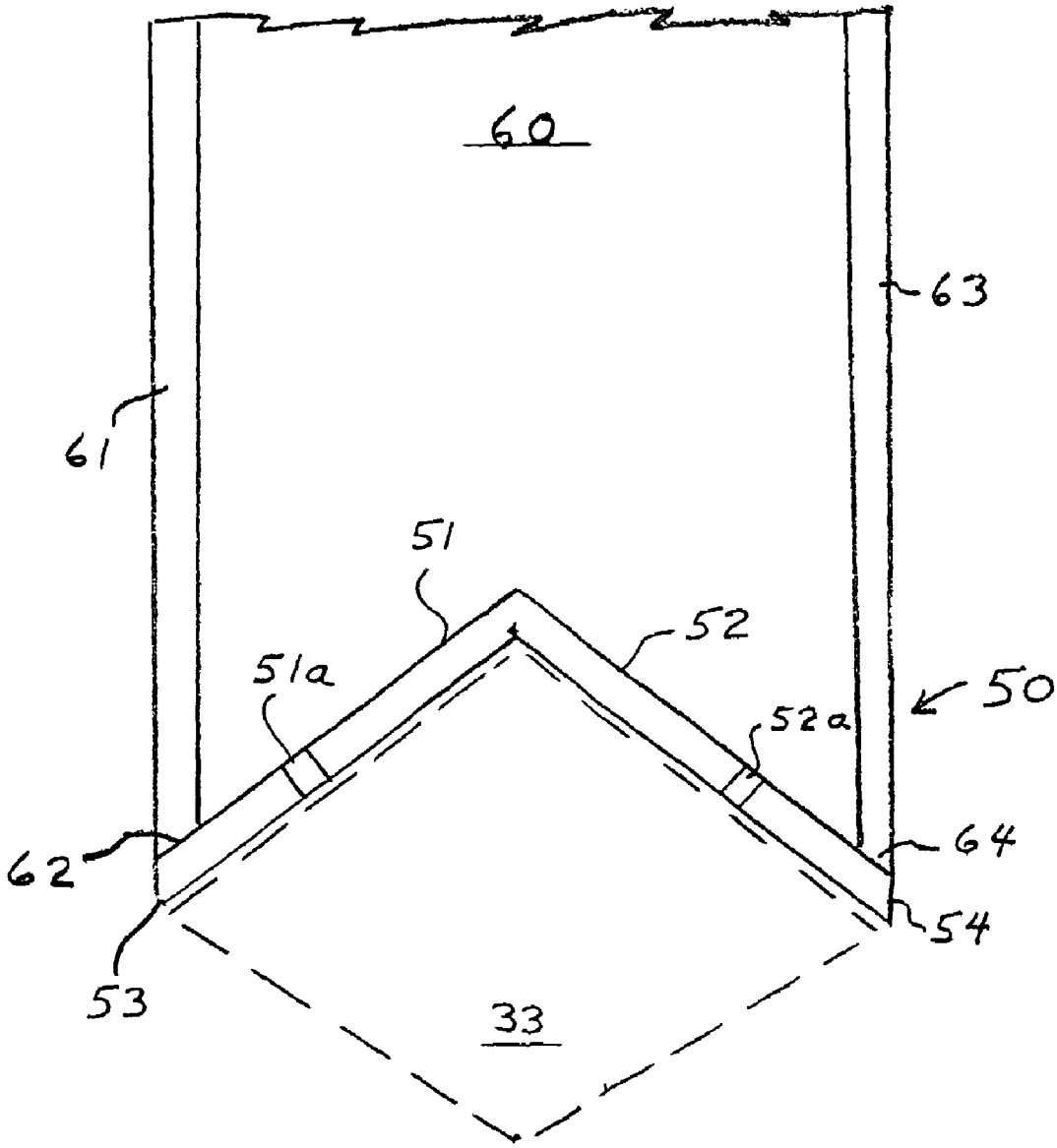
FIG. 4 is a view of the lower and middle sections of the clamp structure.

Referring to FIG. 4, which shows the lower section 50 and the middle section 60, there is shown a first shoulder section 51 and a second shoulder section 52. The shoulders 51 and 52 are mounted to the top rail element 33 by means of bolt apertures 51*a* and 52*a*.

As further shown, the shoulders are at about ninety degrees to each other and have lower edges 53 and 54 respectively.

The middle section 60 has upwardly extending side rails 61 and 63, left and right, which have respective lower portions 62 and 64.

As indicated, the lower edges of the shoulder sections are affixed to the lower rail portions.

Figure 5:
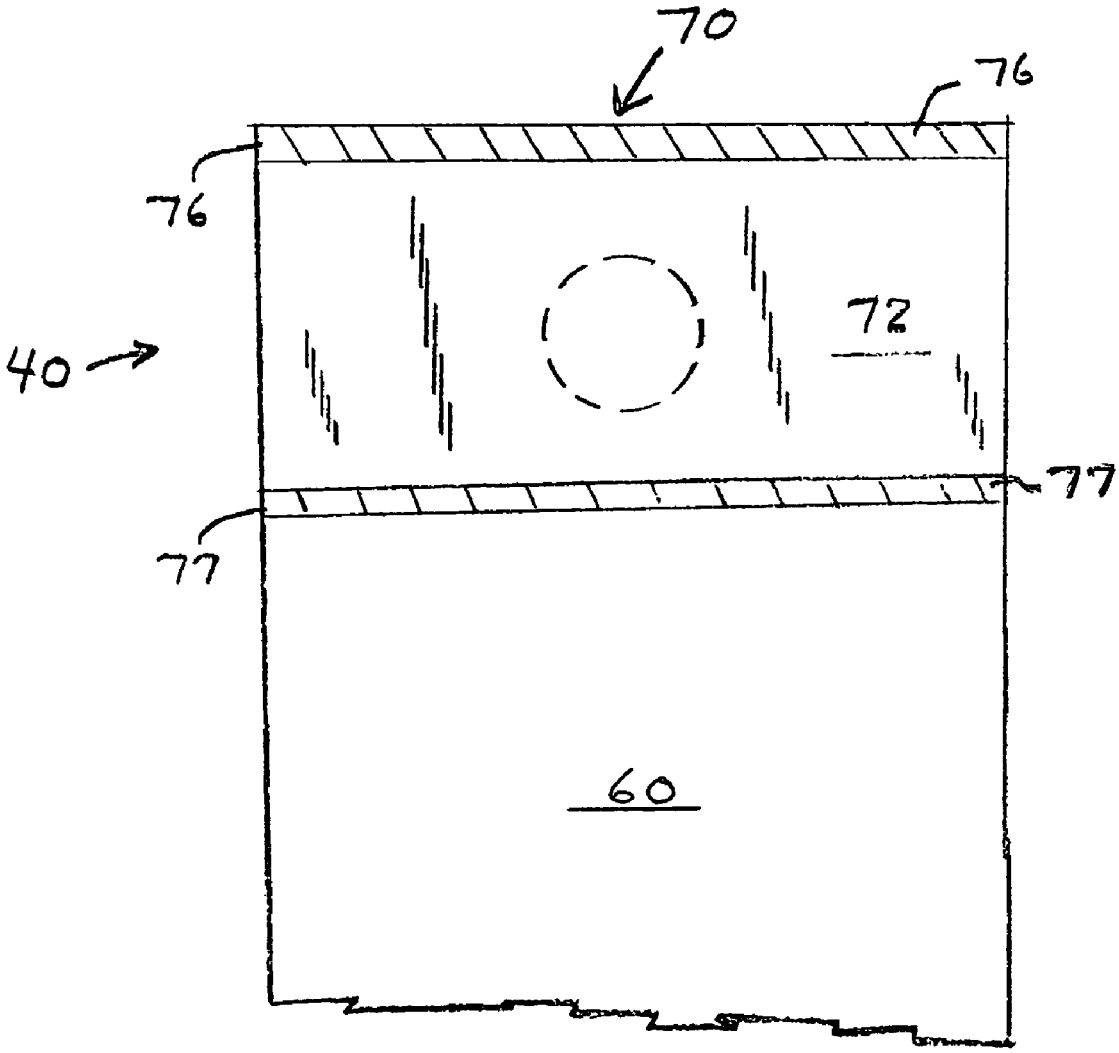
FIGS. 5 and 6 are end and side views, respectively, of the top and middle portions of the clamp structure.
Figure 6:
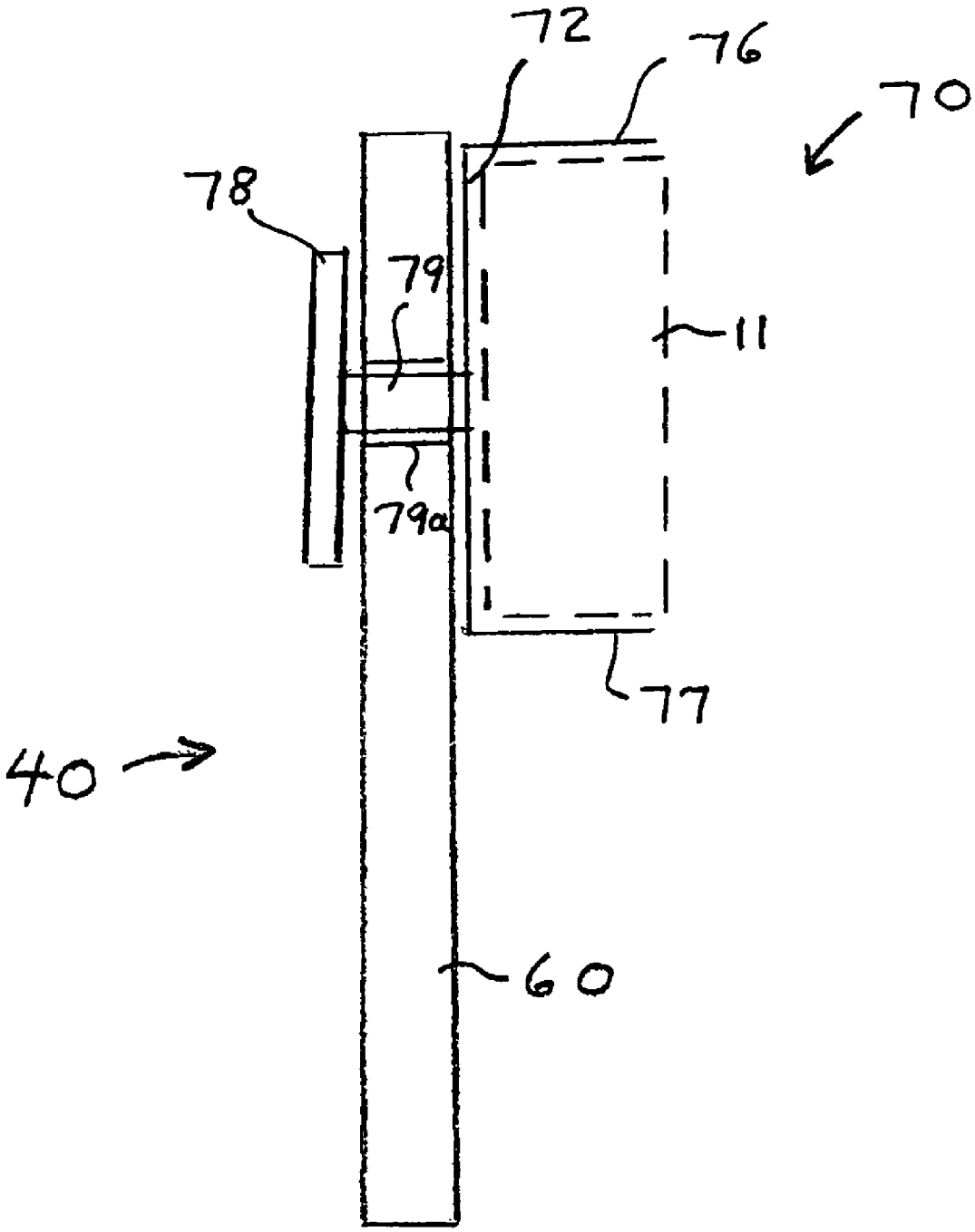

Referring to FIGS. 5 and 6, showing the upper portion 70 of clamp 40, elements 72, 76 and 77 comprise a grasping element for contacting a ladder side rail shown schematically at numeral 11 of FIG. 6.

The grasping element is generally C-shaped and is retained to the upper section 70 by means of a disc-shaped backing plate 78 and a connector element 79 which extends through aperture 79*a* in the upper section 70.

As shown in FIG. 3, the C-shaped element is on the opposite side of the overall clamp 40 from the angled shoulder portions.

The arrangement shown enables a swivel motion of the C-shaped grasping element.

Thus, convenient positioning of an extension ladder is achieved.

It is contemplated that the materials utilized for the fabrication of clamp elements 40 would comprise high-strength metals or hybrid compounds of a type known in the manufacturing arts.

Figure 7:
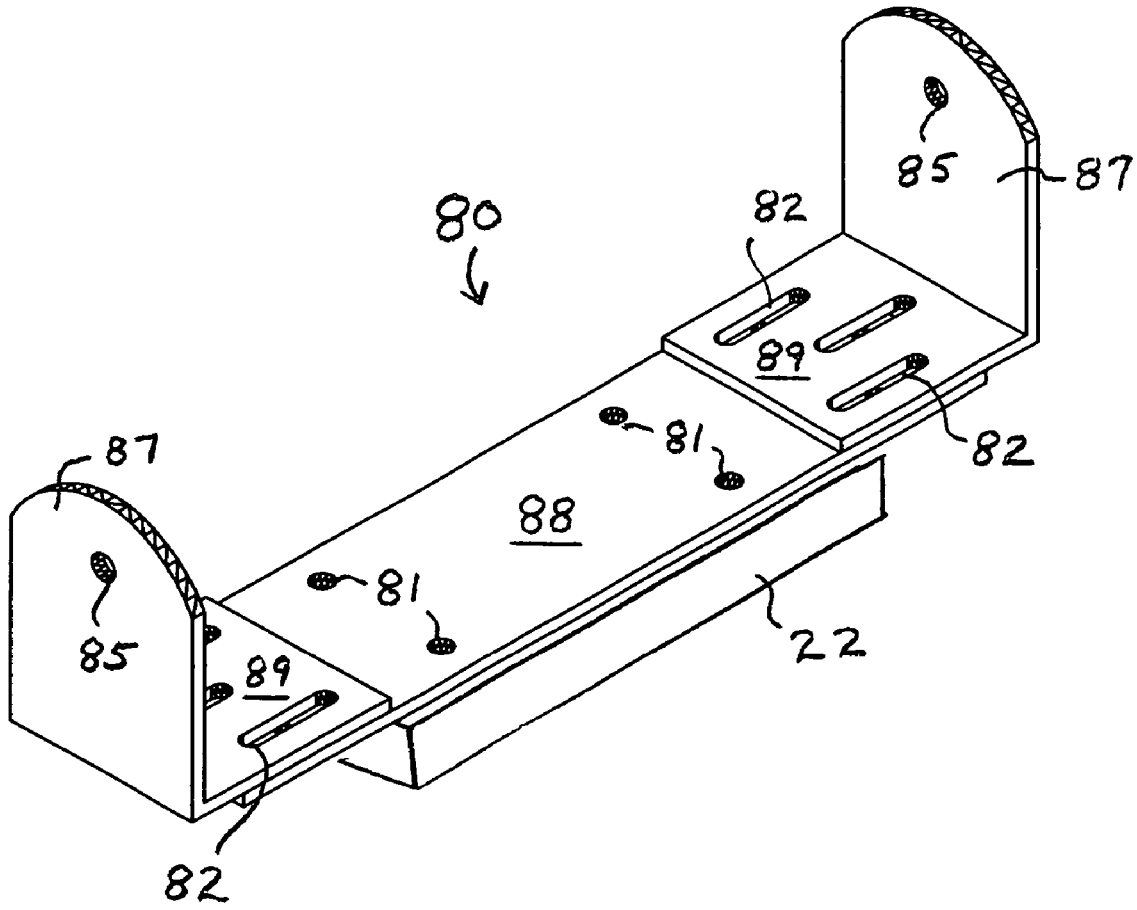
FIG. 7 is a perspective view of the lower ladder support utilized in the invention.

FIG. 7 shows a lower retainer and support structure 80 which retains a lower end of an extension ladder to a truck bed 22.

Retainer structure 80 includes bolt apertures 81 which cooperate with suitable fasteners to affix the retainer 80 to bed 22.

Lower retainer 80 has side wings 87, a lower plate 88 and slide plates 89.

Slotted apertures 82 provide for an adjustment of the retaining member 80 to accomodate extension ladders of various sizes.

Bolt apertures 85 are utilized to affix the lower end of an extension ladder to the lower retainer structure 80.

Figure 8:
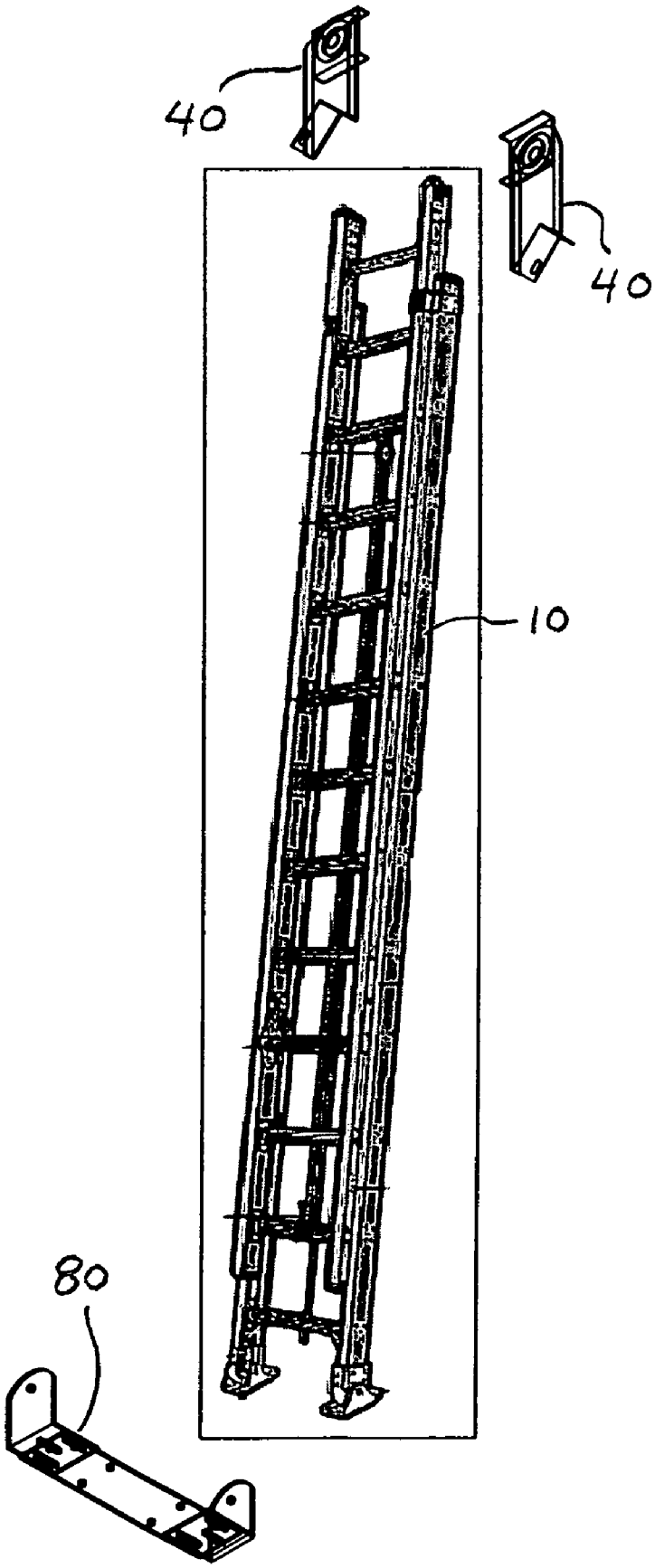
FIG. 8 is an overall view of the system components including the two clamp elements and the lower ladder support and retainer device. These three components may be marketed, for example, in a kit form for widespread distribution in the repair and construction arts.

The lower retainer and support structure 80 is shown in FIG. 8 with the combined extension ladder and the two clamp units 40 which would be used in practice of the invention.

As indicated generally in FIG. 8, the system components comprising two clamp units 40 and the lower retainer structure 80 may be marketed in the form of a three-piece kit for widespread distribution of the system and method of use.

The method steps utilized in practice of the invention are as follows:

A) attaching a pivotable lift 30 having an upper lift rail 33 to a truck bed 22, B) attaching a lower ladder support 80 to a truck bed 22, C) attaching an extension ladder to the lower ladder support in a pivotable fashion, D) pivoting the ladder lift to a desired position, E) attaching the extension ladder to a top rail of the ladder lift using the overall clamp and attaching structure 40.

The method steps utilize the structures which have been previously illustrated including the clamp units 40 and the lower ladder support 80.

While a particular system and method of use have been described and illustrated, it is intended in this specification to cover all equivalent systems and methods which would reasonably occur to those of skill in the art. For example only, the system may be arranged so that the ladder extends to lateral or front locations.

The invention is further defined by the claims appended hereto.

I claim:

1. A System comprising a first and second ladder support clamp, a lift structure having a top rail at one end thereof and pivotally mounted at an opposite end on a truck bed of a truck and a lower ladder support and retainer mounted on the truck bed horizontally spaced from the lift structure and supporting an extension ladder, each ladder support clamp including, in a single unit, a lower section, a middle section and an upper section, wherein said lower section includes a first shoulder and a second shoulder which is at an angle of ninety degrees to said first shoulder, wherein both shoulders having bolt apertures and forming an inverted V-shape base that mounts the ladder support clamps on the top rail of the lift structure, wherein the top rail is rectangular in cross-section, the middle section comprises a flat plate with a left rail and a right rail, wherein a lower edge of said first shoulder is affixed to a lower portion of the left rail and wherein a lower edge of said second shoulder is affixed to a lower portion of the right rail, wherein the upper sections contact part of the extension ladder, wherein each upper section includes a generally C-shaped element which is pivotally mounted via a backing disc to the upper section, wherein the C-shaped elements face each other and engaging respective side rails of the extension ladder, wherein the lower ladder support and retainer includes side wings and a lower plate and slide plates, bolt apertures being provided in the side wings to attach the lower end of the extension ladder to the lower ladder support and retainer and bolt apertures are provided in the lower plate to affix the lower ladder support and retainer to the truck bed.

* * * * *